US009200816B2

(12) United States Patent
Frank

(10) Patent No.: US 9,200,816 B2
(45) Date of Patent: Dec. 1, 2015

(54) HYDROGEN JET PROPULSION SYSTEM

(71) Applicant: David Loron Frank, Highland Beach, FL (US)

(72) Inventor: David Loron Frank, Highland Beach, FL (US)

( * ) Notice: Subject to any disclaimer, the term of this patent is extended or adjusted under 35 U.S.C. 154(b) by 5 days.

(21) Appl. No.: 14/202,803

(22) Filed: Mar. 10, 2014

(65) Prior Publication Data

US 2014/0325987 A1 Nov. 6, 2014

Related U.S. Application Data

(60) Provisional application No. 61/851,809, filed on Mar. 13, 2013, provisional application No. 61/855,140, filed on May 9, 2013.

(51) Int. Cl.

| | |
|---|---|
| ***B63H 11/00*** | (2006.01) |
| ***F24J 1/00*** | (2006.01) |
| ***B63H 11/16*** | (2006.01) |

(52) U.S. Cl.
CPC .. *F24J 1/00* (2013.01); *B63H 11/16* (2013.01)

(58) Field of Classification Search
USPC ..... 440/38, 44, 45
IPC ..... B63H 11/12,11/16
See application file for complete search history.

(56) References Cited

U.S. PATENT DOCUMENTS

| | | | | |
|---|---|---|---|---|
| 3,402,555 | A * | 9/1968 | Piper | 60/227 |
| 4,341,173 | A * | 7/1982 | Hagelberg et al. | 114/20.2 |
| 4,538,996 | A * | 9/1985 | Inwood | 440/38 |
| 5,123,867 | A * | 6/1992 | Broinowski | 440/42 |
| 6,484,491 | B1 * | 11/2002 | Thordarson | 60/211 |
| 2006/0246790 | A1 * | 11/2006 | Goldmeer et al. | 440/45 |

* cited by examiner

*Primary Examiner* — Stephen Avila
(74) *Attorney, Agent, or Firm* — Fleit Gibbons Gutman Bongini & Bianco PL; Jose Gutman

(57) ABSTRACT

A propulsion system for watercraft that uses steam generated from low energy reactor to enable long range high power propulsion. The system preferably uses steam generated from a low energy reactor to provide on-demand steam generated without external power.

17 Claims, 5 Drawing Sheets

HyPERJET MARINE ENGINE

Figure 1 Overview of Propulsion System
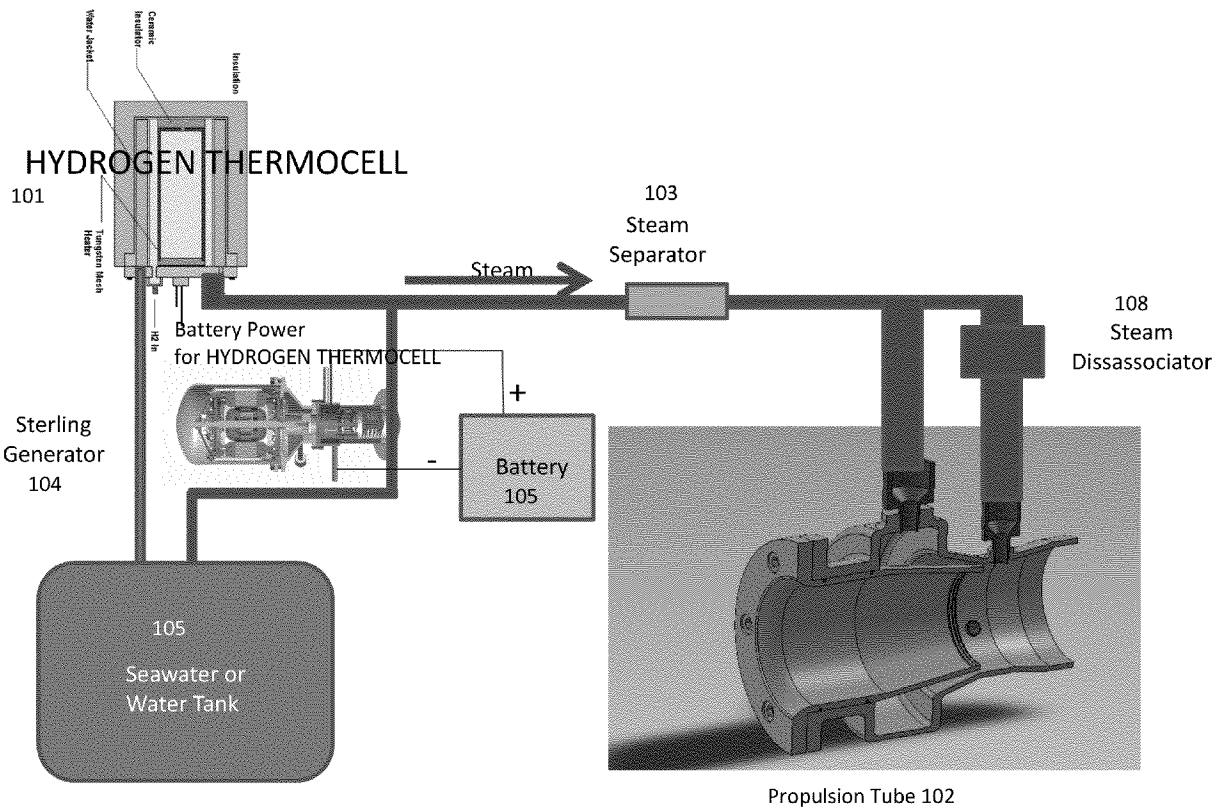

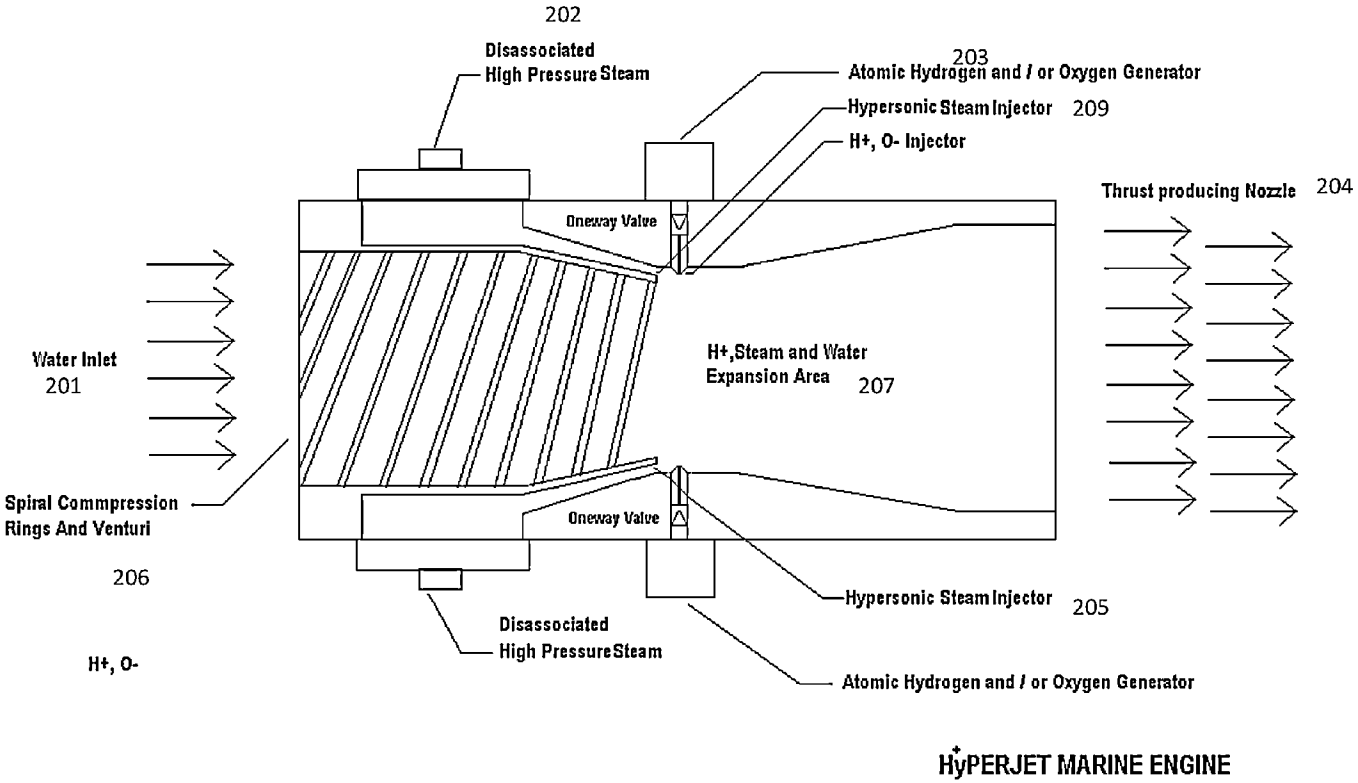
Figure 2 Propulsion Tube

Figure 3 Outboard System Application
In water for propulsion
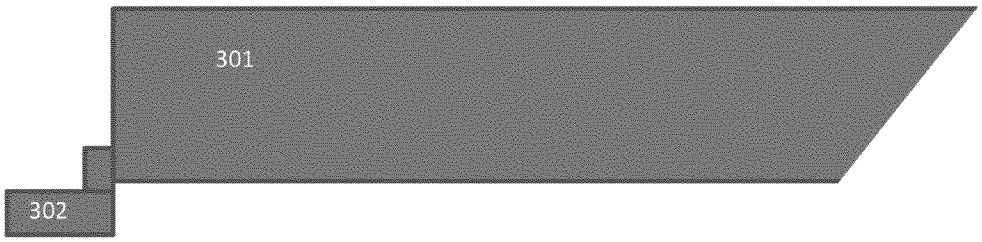
Retracted
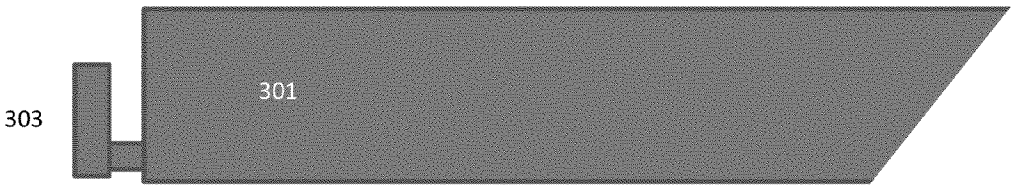

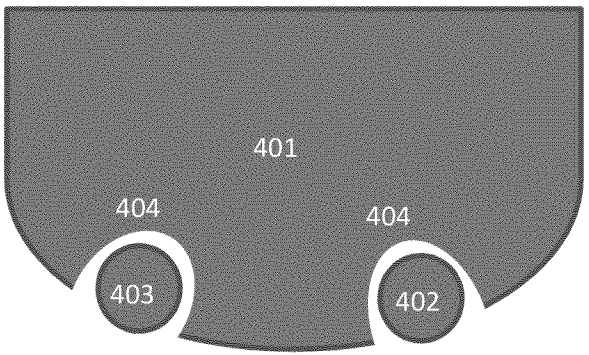
Figure 4 Tunnel Hull Application

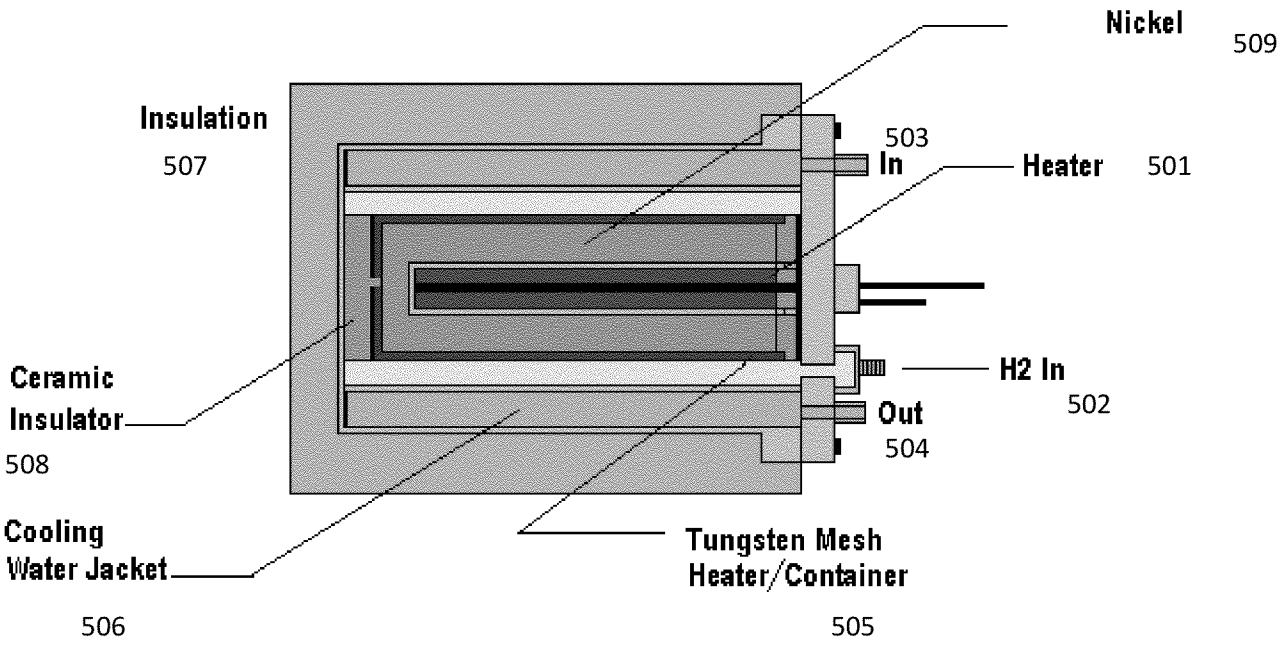
Figure 5 Example Low Energy Reactor

HYDROGEN JET PROPULSION SYSTEM

CROSS-REFERENCE TO RELATED APPLICATIONS

This application claims priority from prior provisional patent application No. 61/851,809 filed on Mar. 13, 2013, and from prior provisional patent application No. 61/855,140 filed on May 9, 2013; the entire collective teachings thereof being herein incorporated by reference.

FIELD OF THE INVENTION

The present invention generally relates to watercraft propulsion systems, and more particularly relates to a hydrogen based propulsion system for watercraft that uses a disassociated hydrogen to create a water jet affect to enable long range high power propulsion. The system preferably uses water converted into atomic hydrogen from a heat source to provide on-demand fuel generation for the propulsion system.

DESCRIPTION OF RELATED ART

There is a great need for a watercraft propulsion system that does not need fossil fuels for combustion engines or stored fuels such as hydrogen an or propane gas to power a propulsion system. Electric motors for watercraft are limited by battery supply, weight and power consumption. Electric boats, other than military watercraft using nuclear power consume some sort of fossil fuel, even for steam engines where the water heater, boiler needs fuel. Current electric motor boats are limited to small craft at slow speeds to enable range. A high speed electric boat traveling at 30 knots could be designed using high power electric motor but would have a short range of 1-2 hours of operation. Current battery technologies and recharging technologies do not support long range operation of boats, yachts or other watercraft at high speeds.

There are several steam based propulsion systems in the commercial industry for moving fluids where the steam is injected into a tube to move fluids through the tube as a propulsion device. Many of these systems use the speed of the converging flow, while others involve the generation of a shock wave where the fluid and steam come together. All of these systems are limited in performance, highly inefficient and have limited power of thrust. These steam jet systems also require electrical energy or fuel to generate steam.

With the rising costs of fossil fuels and the large consumption of fossil fuels by boats in normal operation, a solution to apply long range high power propulsion systems for watercraft that do not consume fossil fuels of natural gas for energy production is required.

SUMMARY OF THE INVENTION

The present invention describes a high performance power and long range propulsion system for watercraft that uses a low energy reactor to generate high heat that can be used to drive a jet propulsion system using dissociated hydrogen, oxygen and steam as fuel. Ordinary hydrogen gas consists of di-atomic molecules in which two H-atoms unite together by covalent bond. This is known as molecular hydrogen. H—H bond energy is very high i.e, 104 Kcal per mole. Due to high bond energy molecule of hydrogen is very stable. It does not react under ordinary conditions. Only those reactions are possible in which at least 104 Kcal per mole of energy is available. Disassociated molecular hydrogen is called atomic hydrogen. Atomic hydrogen is very energetic and very reactive. It has a very short life and spontaneously combine to form molecular hydrogen. Disassociated hydrogen can be created with the application of high heat.

The atomic hydrogen reactor power system is a low energy reactor (HYDROGEN THERMOCELL) that produces an exothermal reaction creating large amounts of heat energy for a very long period of time. The HYDROGEN THERMOCELL can be used to generate continuous steam on-demand to drive an underwater jet propulsion system and simultaneously drive a power generator.

More particularly the invention is concerned with the provision of an improved fluid mover having essentially no moving parts.

One or more generators are driven from the steam created by the heat from the Low energy reactor(s). The generator provides power to the electronic components, electric utilities and recharges the batteries. The power generator could be any power generator such as a heat driven sterling generator, steam turbine generator or thermovoltaic electric generator.

An example of a low energy reactor is a Hydrogen ThermoCell which combines nickel powder hydrogen under heat and pressure to create an exothermal reaction resulting in high heat. The heat is used to create steam which is split into hydrogen and oxygen. Additional heat is further applied to the hydrogen to form atomic hydrogen.

The exothermal reaction of the current invention is both self-sustained and self-regulating maintaining a consistent energy level enabling a commercial system for power generation.

The system is designed to expand the range, speed and improve general operation of a watercraft, boat or large vessel capable of high speeds and long range. This system could also be applied to sail boats and personal watercraft such as a jet ski.

The high pressure atomic hydrogen, oxygen and steam (propulsion mix) are applied at the rear of a propulsion tube. The propulsion tube is attached behind the midsection or at the rear of the watercraft. The energy transfer between the water in the propulsion tube and the propulsion mix creates a powerful thrust of water out of the rear of the propulsion tube propelling the watercraft.

The propulsion tube can have rifling grooves or ridges across the inside surface of the tube to increase power and efficiency of the propulsion tube.

Air can be introduced into the propulsion tube prior to the steam input to increase power and efficiency of the propulsion tube.

Steam can be split into hydrogen and oxygen using a high temperature grid for the steam to pass through prior to entering the propulsion tube. The Oxygen and Hydrogen that comprise the steam are separated and the individual oxygen and hydrogen atoms. The hydrogen is further disassociated into atomic hydrogen to form the propulsion mix.

The recombination of the atomic hydrogen and oxygen to form water releases energy that is applied to the propulsion tube when disassociated oxygen and hydrogen still in heated form come in contact with the water flowing through the propulsion tube.

The propulsion tube can have rifling grooves or ridges across the inside surface of the tube to increase power and efficiency of the propulsion tube.

The propulsion mix input and or air input to the propulsion tube can be designed to enter the front or back portions of the propulsion tube. Valves can be used to switch the steam input to drive the propulsion tube forward or in reverse.

The propulsion tubes may be mounted on a moveable platform to direct the propulsion tube in up to 360 degrees. This allows for exceptional maneuverability of the water craft.

The propulsion tubes may be mounted inside a grove in the hull to minimize the water craft draft. One or more propulsion tubes may be combined for coordinated thrust.

The propulsion system may be used as a bow or stern thruster mounted inside or outside of the hull. The propulsion watercraft is defined as a personal water craft, jet ski, a small boat less than 20 feet in length, a medium sized boat less than 40 feet in length or a large boat or a large vessel longer than 40 feet in length, a submarine vessel or any other water craft that requires propulsion.

Although specific embodiments of the invention have been disclosed, those having ordinary skill in the art will understand that changes can be made to the specific embodiments without departing from the spirit and scope of the invention. The scope of the invention is not to be restricted, therefore, to the specific embodiments, and it is intended that the appended claims cover any and all such applications, modifications, and embodiments within the scope of the present invention.

BRIEF DESCRIPTION OF THE DRAWINGS

FIG. 1 Overview of Propulsion System
FIG. 2 Propulsion Tube
FIG. 3 Outboard System Application
FIG. 4 Tunnel Hull Applications
FIG. 5 Overview of Low Energy Reactor

DETAILED DESCRIPTION OF THE INVENTION

In FIG. 1 we present an overview of propulsion system. The low energy reactor (101) provides the heat energy in the form of steam to drive a generator (104) to supply electricity to the system and the propulsion tube (102). The steam separator (103) is used to separate hydrogen and oxygen in the steam and uses high temperature electrolysis to accomplish this. The steam separator (high temperature electrolysis) may use electrical current to assist in the electrolysis process. The steam dissassociator (108) uses a high temperature grid to break the hydrogen and or oxygen atoms apart to form atomic hydrogen and or atomic oxygen. The batter (105) is used to start the system and is recharged from the generator (104). Seawater, freshwater or water from a storage tank is used (105) to supply the low energy reactor (101).

In FIG. 2 we illustrate the propulsion tube where steam or separated steam in to hydrogen and or oxygen or a combination of steam and or hydrogen and oxygen (202) is applied to the expansion area of the propulsion tube (207). Water enters the propulsion tube at one end (201) passes through the rifling grooves (206) and is exposed to the high pressure steam, oxygen and or hydrogen (209) in the expansion area (207). A heat and chemical reaction occurs with the combination of the water intake, high pressure steam, hydrogen and or oxygen. The hydrogen and oxygen recombine creating in the expansion area (207) an exothermal heat reaction thrusting the water and steam out of the back (204) end of the propulsion tube.

Atomic hydrogen and or atomic oxygen can also be applied (203) to the expansion area to further increase performance and thrust (204).

In FIG. 3 we illustrate the deployment as an outboard system, in FIG. 4 we illustrate the deployment as a tunnel hull application where the vessel hull (401) has one or more tunnels applied (404) with propulsion tubes (403) inside the tunnels.

FIG. 5 shows the overview of a Low Energy Reactor that uses the reaction between nickel (409) and atomic hydrogen (502) applied at temperature and pressure to create an exothermal heat reaction. The water (503) passing through and around the low energy reactor is turned to high temperature steam (504) at approximately 800 degrees Celsius.

The invention claimed is:

1. A high performance tubular propulsion system comprising:

A low energy reactor system for generating heat, and applying said heat to a water source to create a propulsion mix of: steam, hydrogen, oxygen, and/or atomic hydrogen;

One or more propulsion tubes coupled with the low energy reactor system, each propulsion tube for being placed underwater injecting the propulsion mix under pressure through the propulsion tube creating a jet propulsion effect; and each propulsion tube allowing water to enter at one end and ejecting water out of the opposing end creating propulsion, wherein injected steam molecules are disassociated by passing the steam molecules through one or more high temperature grid(s) separating the components of the steam into hydrogen and oxygen.

2. The propulsion system of claim 1, wherein the steam is created using a low energy reactor where water is applied around the reactor creating a propulsion mix on-demand.

3. The propulsion system of claim 1, wherein atomic hydrogen and or atomic oxygen is injected into the propulsion tube to create additional chemical and heat reactions to increase overall performance.

4. The propulsion system of claim 1, wherein the steam is created using a commercially available heater and or heat generator.

5. The propulsion system of claim 1, where the propulsion tube reactions and performance are monitored using a microprocessor coupled to at least one sensor.

6. The propulsion system of claim 1, where the propulsion mix can be designed to enter front or back portions of the propulsion tube and switched on by valves to drive the propulsion tube in forward or in reverse propulsion.

7. The propulsion system of claim 1, where the inside of the propulsion tube is equipped with ridges that form a rifling effect for the water as it passes through the tube.

8. The propulsion system of claim 1, where the one or more propulsion tubes are mounted on a moveable platform to direct the one or more propulsion tubes in up to 360 degrees.

9. The propulsion system of claim 1, where the heat generated from the low energy reactor can also be used to drive an electrical generator system.

10. The propulsion system of claim 1, where the one or more propulsion tubes are mounted at the end of a watercraft with tilt and an ability to raise each propulsion tube out of the water.

11. The propulsion system of claim 1, where the propulsion tubes are mounted similar one or more outdrives at the end of the watercraft with tilt and an ability to raise the propulsion tube out of the water.

12. The propulsion system of claim 1, where the propulsion tube is used as a bow or stern thruster mounted inside or outside of the hull.

13. The propulsion system of claim 1 where the one or more propulsion tubes power a watercraft.

14. The propulsion system of claim 13 where the watercraft comprises at least one of: a personal water craft, a jet ski, a small boat less than 20 feet in length, a medium sized boat less than 40 feet in length, or a large boat or a large vessel longer than 40 feet in length, a submarine vessel, or any other water craft that requires propulsion.

15. A high performance tubular propulsion system comprising:

a low energy reactor system for generating heat, and applying said heat to a water source to create a propulsion mix of: steam, hydrogen, oxygen, and/or atomic hydrogen;

one or more propulsion tubes coupled with the low energy reactor system, each propulsion tube for being placed underwater injecting the propulsion mix under pressure through the propulsion tube creating a jet propulsion effect; and each propulsion tube allowing water to enter at one end and ejecting water out of the opposing end creating propulsion, wherein injected steam molecules are disassociated by passing the steam molecules through one or more high temperature grid(s) with voltage applied to separate the components of the steam into hydrogen and oxygen.

16. A high performance tubular propulsion system comprising:

a low energy reactor system for generating heat, and applying said heat to a water source to create a propulsion mix of: steam, hydrogen, oxygen, and/or atomic hydrogen;

one or more propulsion tubes coupled with the low energy reactor system, each propulsion tube for being placed underwater injecting the propulsion mix under pressure through the propulsion tube creating a jet propulsion effect; and each propulsion tube allowing water to enter at one end and ejecting water out of the opposing end creating propulsion, wherein hydrogen and oxygen atoms are further disassociated by passing through one or more high temperature grid(s) breaking apart the atomic structure.

17. The propulsion system of claim 9, where the electrical generator system comprises at least one of: a sterling generator, a thermoelectric device, or a steam driven generator.

* * * * *